US008033599B2

(12) United States Patent
Meeker et al.

(10) Patent No.: US 8,033,599 B2
(45) Date of Patent: Oct. 11, 2011

(54) INFANT CARRIER HANDLE

(75) Inventors: Paul K. Meeker, Hiram, OH (US); William R. Gibson, Kent, OH (US); Michael G. Gross, Tipp City, OH (US)

(73) Assignee: Meeker R & D, Inc., Hiram, OH (US)

( * ) Notice: Subject to any disclaimer, the term of this patent is extended or adjusted under 35 U.S.C. 154(b) by 193 days.

(21) Appl. No.: 12/039,184

(22) Filed: Feb. 28, 2008

(65) Prior Publication Data

US 2008/0258516 A1 Oct. 23, 2008

Related U.S. Application Data

(60) Provisional application No. 60/913,068, filed on Apr. 20, 2007.

(51) Int. Cl.
*A47C 31/00* (2006.01)

(52) U.S. Cl. ..... 297/183.3; 297/183.6; 16/111.1; 40/320; 40/661.12

(58) Field of Classification Search ..... 297/183.1, 297/183.2, 183.6, 183.3; 16/111.1, 110.1, 16/421; 40/299.01, 305, 318, 320, 661.12
See application file for complete search history.

(56) References Cited

U.S. PATENT DOCUMENTS

| | | | | |
|---|---|---|---|---|
| 3,965,589 | A | 6/1976 | McDermott | |
| 4,121,360 | A | 10/1978 | Vlerebome | |
| 5,193,855 | A | 3/1993 | Shamos | |
| 5,267,680 | A | 12/1993 | Torok | |
| 5,324,094 | A | 6/1994 | Kain | |
| 5,409,292 | A | 4/1995 | Kain et al. | |
| 5,423,574 | A | 6/1995 | Foret-Pathroff | |
| 5,516,190 | A | 5/1996 | Kain et al. | |
| 5,579,556 | A * | 12/1996 | Chung | 16/110.1 X |
| 5,608,382 | A | 3/1997 | Webb et al. | |
| 5,651,581 | A | 7/1997 | Myers et al. | |
| 5,658,044 | A | 8/1997 | Krevh | |
| 5,775,770 | A | 7/1998 | Tunney | |
| 5,900,817 | A | 5/1999 | Olmassakian | |
| 6,061,943 | A | 5/2000 | Pepys | |
| 6,084,513 | A | 7/2000 | Stoffer | |
| 6,144,304 | A | 11/2000 | Webb | |
| 6,149,489 | A | 11/2000 | Johnson | |
| 6,196,562 | B1 * | 3/2001 | Zhuang | 16/110.1 X |
| 6,255,951 | B1 | 7/2001 | De La Huerga | |
| 6,346,886 | B1 | 2/2002 | De La Huerga | |
| 6,367,875 | B1 | 4/2002 | Bapst | |
| 6,378,937 | B1 | 4/2002 | Faudman | |
| 6,626,489 | B2 | 9/2003 | Geis et al. | |
| 6,655,063 | B2 | 12/2003 | Goodin et al. | |
| 6,766,039 | B1 | 7/2004 | Al-Sheikh | |
| 6,913,313 | B2 | 7/2005 | Sedlack | |
| 6,976,327 | B2 | 12/2005 | Goodin et al. | |
| 6,977,586 | B2 | 12/2005 | Martin et al. | |
| 6,983,986 | B2 | 1/2006 | Santamaria | |
| 7,034,690 | B2 | 4/2006 | Chaco | |
| 7,265,666 | B2 | 9/2007 | Daniel | |
| 7,322,613 | B2 | 1/2008 | Penuela et al. | |
| 7,420,472 | B2 | 9/2008 | Tran | |

* cited by examiner

*Primary Examiner* — Anthony D Barfield
(74) *Attorney, Agent, or Firm* — Hahn, Loeser & Parks LLP

(57) ABSTRACT

The invention of this application relates to an infant carrier with carry handle wherein the carry handle is adapted to facilitate easier, more comfortable carrying in the crook of one's elbow and wherein the carry handle is adapted to removably display a printed image or other indicia, such as safety or identification indicia.

18 Claims, 7 Drawing Sheets

INFANT CARRIER HANDLE

TECHNICAL FIELD

The invention of this application relates to an infant carrier with carry handle wherein the carry handle is adapted to facilitate easier, more comfortable carrying in the crook of one's elbow and wherein the carry handle is adapted to removably display a printed image or other indicia.

BACKGROUND OF THE INVENTION

Infant carriers are well-known and used to easily carry an infant from place-to-place as well as for seating an infant for feeding, sleeping, or playing. These carriers generally comprise a plastic shell with a seating surface, sides, an adjustable carry handle, rocker shaped bottom runners, a restraint harness, and a pad.

Infant carriers are often used as infant car seats either by themselves or with the addition of a base. If the carriers are used as a car seat by themselves, they have hooks of some kind which can be used to secure them to an automobile by means of the automobile seat belt. If they are used with a base, the base has a somewhat torso-shaped contour over which an automobile seatbelt is passed to secure the base in the automobile. The carrier is then removably secured to the base in some way.

Infant car seats have progressed over the years. The first infant car seat was little more than a double-walled plastic dish pan (the GM Loveseat™ ). Evenflo Company, Inc. advanced the state-of-the-art with a lightweight infant car seat with an adjustable angle (the Dyn-o-mite™). Century followed with an infant car seat with a carry handle and stay-in-the-car base (the Century 580™). Other manufacturers have also added improvements as they introduced new models. The various seats have provided good protection in transporting children in automobiles as well as good function as infant carriers.

Infant seat carry handles have also progressed. Many means of adjustment of the carry handle angle have been developed and carry handles have been made in many configurations. The earliest handles were shown on the Infanseat brand infant carrier and were a simple wire frame with a molded plastic handle—much like a bucket bail or handle. Handles later became molded plastic with molded-in grips and appear in many configurations.

Carrying an infant in an infant seat is not as easy as one might expect The infant can weigh up to twenty pounds—or even more. The carrier itself adds some weight and when the carrier is robust enough to be used as an infant car seat, the added weight of the carrier itself can be several pounds A mother may not be overly strong, may also be carrying additional items such as groceries, and/or may need to be, say, opening a car door at the same time she is carrying the seat and infant and it may be raining or cold. In addition, the mother (or father) wants to carry the infant as securely as possible without excessive motion or swinging.

Manufacturers have tried many variations in handle shape to make carrying easier. Evenflo introduced a "Z" shaped handle in which the central grip is parallel to the child's torso, as shown in U.S. Pat. No. D536,908. Dorel Juvenile Group, through its Cosco brand, introduced a rotating handle intended to let the consumer choose the best angle for themselves. Other manufacturers have introduced additional variations from bifurcated to "W"-shaped handles, as shown in U.S. Pat. No. 5,658,044.

Despite many advances, infant seat carry handles are not perfected and are not as obvious in their use, as easy to use, as comfortable, or as enjoyable to use as they could be.

This invention continues the advancement of infant seat carry handles by making their use more obvious, easier, more comfortable, and more enjoyable in carrying an infant. It further provides a prominent display area for a child's or family photo for identification and/or important information such as emergency phone numbers or medical information.

SUMMARY OF THE INVENTION

The present invention relates to an infant carrier with carry handle wherein the carry handle is adapted to facilitate easier, more comfortable carrying in the crook of one's elbow and wherein the carry handle is adapted to removably display a printed image or other indicia. The infant carrier of certain embodiments of the invention include a carry handle wherein the carry handle comprises left and right curved or straight legs and a curved or straight top grip area connected to the curved or straight legs by left and right curved sections. In one embodiment of the invention, the curved or straight legs, top grip area, and connecting curved sections are a continuous metal extrusion or roll-form of essentially uniform cross section. The advantages of the metal extrusion include ease of fabrication, low tooling cost, light weight and small size for a given strength. The construction may also be of molded plastic and either uniform or non-uniform in cross section.

The left and right curved sections are fit with enlarged cushion areas intended to allow carrying in the crook of one's elbow and wherein the enlarged cushion areas distribute the weight of the infant carrier and infant over a larger area of one's arm and thus make carrying more comfortable. The enlarged cushion areas may be fitted with soft pads to further enhance the comfort of the handle in the crook of one's elbow.

The enlarged cushion areas may be molded integrally with the carry handle if the handle is molded of a plastic material The molding operation may be accomplished by injection molding, blow molding, gas assist molding, or other process allowing a uniform or non-uniform cross-section. In this case, the enlarged cushion areas may also be fitted with soft pads for comfort.

In a preferred embodiment, however, the carry handle is metal and made of extruded aluminum or other lightweight but strong material and the enlarged cushion areas are made of molded plastic, such as polypropylene, and are made with an inner cushion component and an outer cushion component which are secured together and over the extruded handle with screws, rivets, or other fastening means. Further, in this preferred construction, each inner cushion component is fit with a rubber, foam, or other soft pad in the area contacting the user's arm This construction allows optimization of the lightness and strength of the carry handle as well as the form and cushioning of the enlarged cushion areas. There are several options for padding of the enlarged cushion areas. For example, the soft pads can be made of a foam elastomer with some desirable density, or it can be made of solid rubber or other molded elastomer of a desirable firmness, or it can be made of a rubber or other molded elastomer and partially hollowed out from the back to make it have a softer feel. The enlarged cushion areas can also be made without an additional soft pad.

The outer cushion component of each enlarged cushion area has an outer face which may be decorated with a logo, instructions, or similar graphics of either a functional or decorative nature. However, the preferred outer faces have a picture area intended to accept a cut-out shape of a printed image or other identification indicia and a trim bezel to secure the printed image or other indicia The picture areas are preferably recessed, but may be flush. The trim bezels are preferably easily removable or sufficiently deformable so as to allow replacement of a manufacturer supplied printed image with a consumer supplied printed image or indicia. Thus the manufacturer may, for example, put sales information in this highly visible area and the consumer may replace the sales information with, say, a photograph of their child or family to identify each for daycare pickup or important emergency contact or medical information such as baby's allergies or other safety or identification indicia, such as a lock of hair, footprint, or fingerprint. The picture area may also be recessed sufficiently to allow for the insertion of other security features, including but not limited to a small tracking or GPS device, allowing the families or authorities to locate the infant carrier, and likely the infant within the carrier should their be such a need in the case of an abduction, vehicle theft or other emergency In the preferred embodiment, the trim bezel also secures a thin, flexible protective lens which may be removed with the printed image and used as a template for the consumer to cut out a picture of their choice to replace the manufacturer's printed image. The bezels and protective lenses are preferably independent of each other, but may be attached to each 9 other, or molded integrally together The protective lens may also be used to protect the picture or indicia within the picture area. The protective lens may also be replaceable with an opaque or other solid lens or piece to hide the picture area if the picture area is not being used, or if it is not desired that others see what is within the picture area.

It is an object of this invention to allow a more obvious and a more comfortable means for carrying an infant carrier in the crook of one's elbow by providing an enlarged, cushioned area in each corner curved section of the infant carrier carry handle while optimizing the carry handle for maximum strength and minimum weight at reduced cost.

Another object of this invention is to provide a means for securing enlarged cushion areas to an extruded infant carrier carry handle of nominally uniform cross section.

Yet another object of this invention is to provide a display area for a printed image, photograph, or other important information on the outside of an infant carrier handle and a means for securing and easily replacing the printed image.

An additional objective of this invention is to provide enlarged cushioned areas on an infant carrier carry handle to provide a more comfortable means for carrying the infant carrier in combination with a means for removably securing a printed image on the outside of the infant carrier handle.

These objectives and advantages are obtained by the infant carrier handle described herein. These and other objects of the present invention will become more readily apparent from a reading of the following detailed description taken in conjunction with the accompanying drawings wherein like reference numerals indicate similar parts, and with further reference to the appended claims.

BRIEF DESCRIPTION OF THE DRAWINGS

The preferred embodiment of the invention, illustrative of the best mode in which applicant has contemplated applying the principals is set forth in the following description and is shown in the drawings and is particularly and distinctly pointed out and set forth in the appended claims. The invention may take physical form in certain parts and arrangements of parts, numerous embodiments of which will be described in detail in the specification and illustrated in the accompanying drawings which form a part hereof, and wherein:

DETAILED DESCRIPTION OF THE INVENTION

Figure 1:
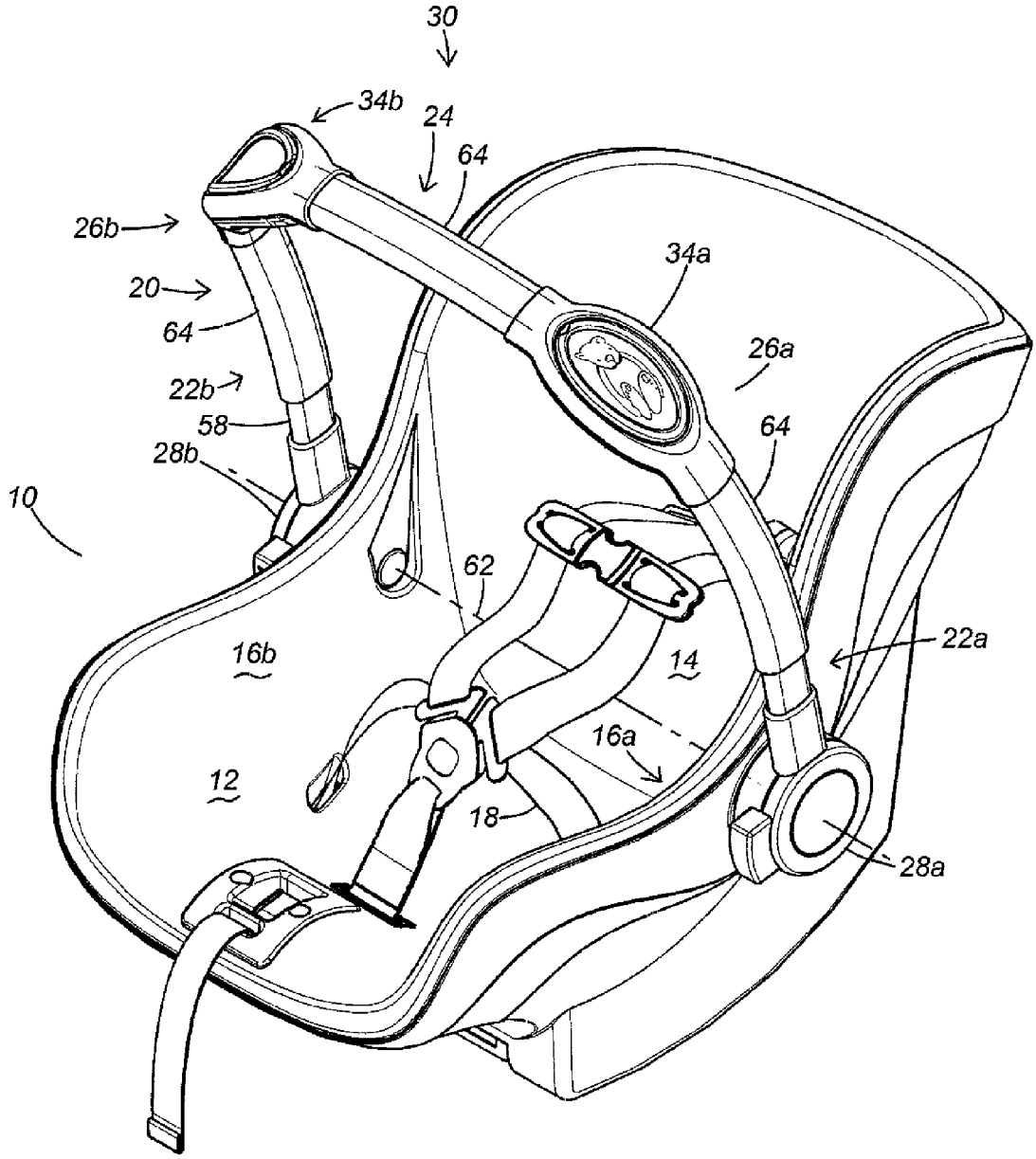
FIG. 1 is a front perspective view of the infant carrier with its handle in an upright, or carrying position.

Referring now to the drawings wherein the showings are for purposes of illustrating numerous embodiments of the invention only and not for purposes of limiting the same, the figures illustrate the novel idea of an infant carrier with carry handle wherein the carry handle is adapted to facilitate easier, more comfortable carrying in the crook of one's elbow and wherein the carry handle is adapted to removably display a printed image.

Looking now at FIG. 1, an infant carrier 10 generally comprises a seating surface 12, a backrest surface 14, left and right side walls 16*a*, 16*b*, a harness system 18, and a carry handle 20. Infant carriers also have pads (not shown) and often have car seat bases (not shown), and various other details.

Carry handle 20 is comprised of curved or straight left and right legs 22*a*, 22*b*, which are generally vertical in structure, and curved or straight top leg, also referred to as a grip area 24, which is generally horizontal in structure. In general, essentially horizontal leg 24 connects pair of essentially vertical legs 22*a*, 22*b*. In a preferred embodiment, generally horizontal leg 24 is connected to pair of generally vertical legs 22*a*, 22*b* by curved sections 26*a*, 26*b*. There are no limits to the degree of the curve of curved sections 26*a*, 26*b*, as the purpose of the curve is for comfort of the user in the carrying of the infant carrier. It is further foreseen that the configuration of the connection of generally horizontal leg 24 to generally vertical legs 22*a*, 22*b* may be altered for structural or aesthetic reasons. Examples of alternative connections include connecting generally horizontal leg 24 and pair of generally vertical legs 22*a*, 22*b* at an approximately 90° angle. A further alternative includes connecting generally horizontal leg 24 and pair of generally vertical legs 22*a*, 22*b* at an approximately 90° angle while having curved sections within the structure of generally horizontal leg 24 and pair of generally vertical legs 22*a*, 22*b* for the comfort of the user in carrying the infant carrier. The legs of the handle will commonly be constructed having an outer and inner face, wherein the outer and inner faces are separated by a width.

Figure 2:
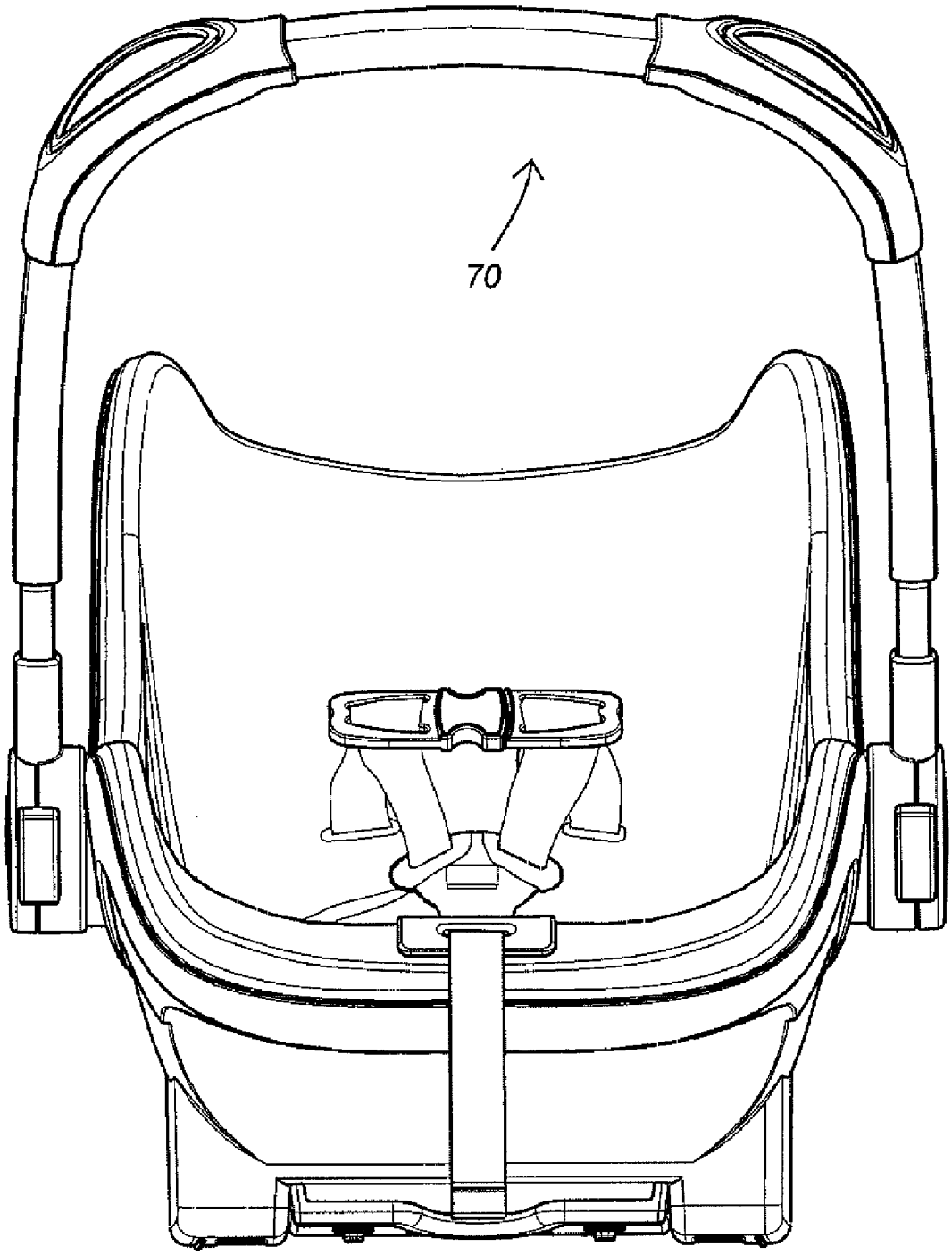
FIG. 2 is a front view of the infant carrier showing the inverted "U" shape of the carry handle.
Figure 5:
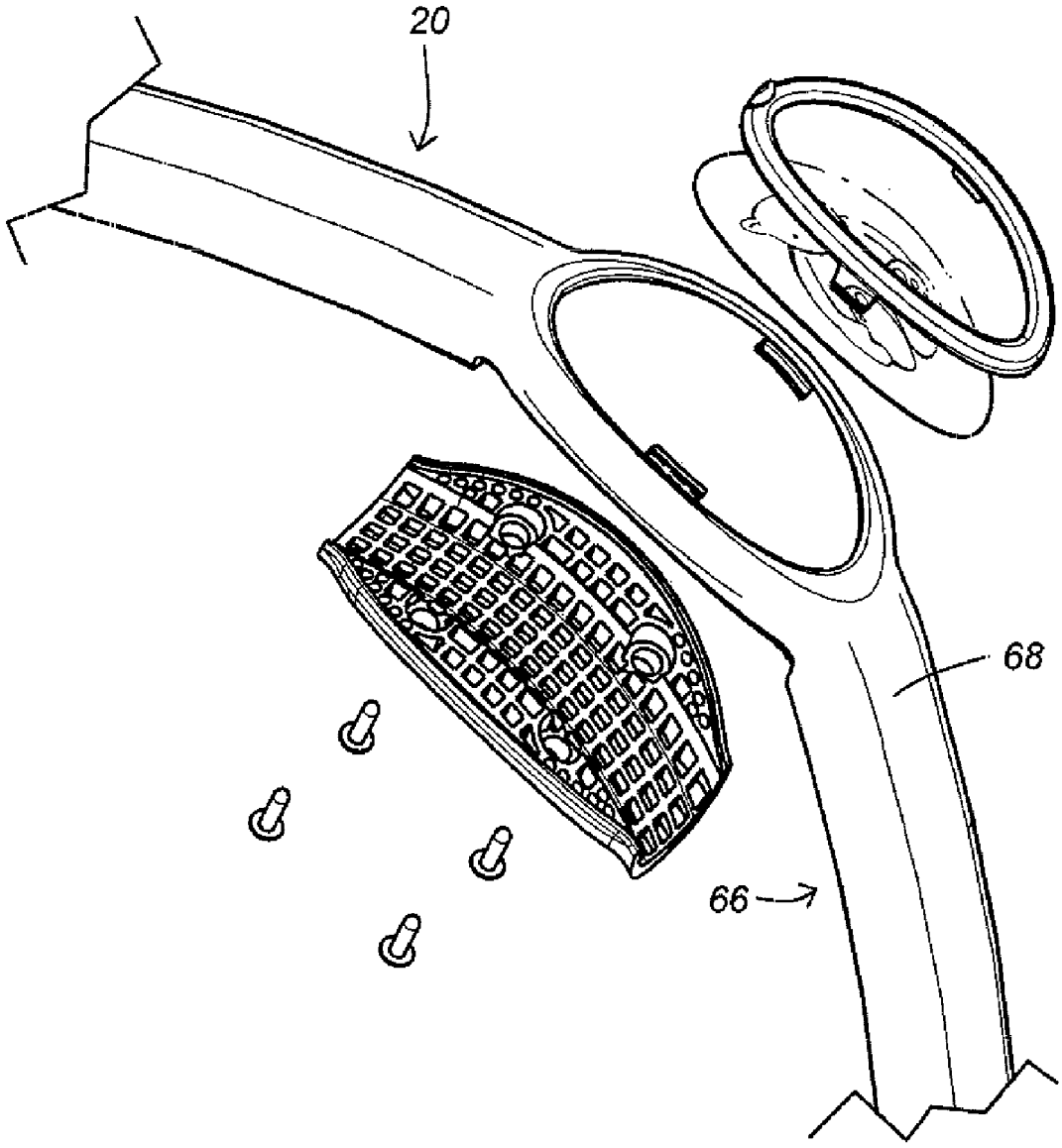
FIG. 5 is a partial exploded view showing an alternative construction with a one-piece handle.
Figure 6:
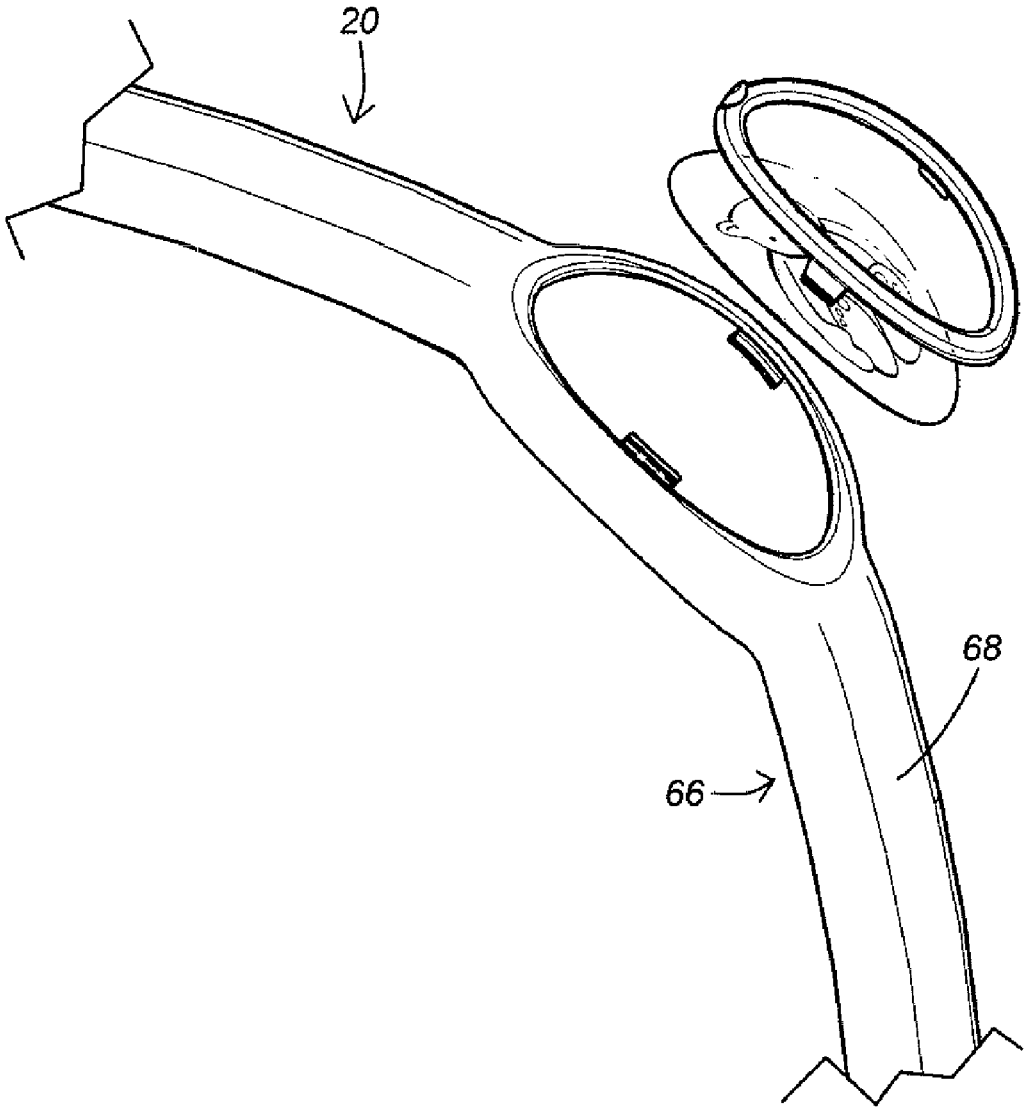
FIG. 6 is another partial exploded view of another alternative one-piece handle construction without a soft pad.

Carry handle 20 is rotatably connected to infant carrier 10 at hubs 28*a*, 28*b* which rotate on common axis 62 and index the carry handle 20 to one of several positions. Carry handle 20 is shown in its upright or carrying position 30. In its preferred embodiment carrying handle 20 left and right legs 22*a*, 22*b*;top grip area 24; and curved sections 26*a*, 26*b* are an aluminum extrusion 58 of essentially uniform cross section to maximize strength and minimize weight. Aluminum extrusion 58 may alternatively be constructed of steel, fiber glass or other material or a roll-form. Sections of carry handle 20 may be covered with foam padding 64, fabric or other material to protect the handle, increase ease and comfort of carrying the carrier by the handle, for decoration, or many other purposes. Carry handle 20 may alternatively be made of molded plastic and have a non-uniform in cross section as illustrated in FIG. 5 and FIG. 6. As shown in FIG. 5 and FIG. 6, carry handle 20 has an inner face 66 and an outer face 68. Carry handle 20 has a contour when viewed from any direction, but when viewed from the front of the infant carrier 10 with carry handle 20 in its carrying position 30, the contour is an inverted U-shape 70 as shown in FIG. 2.

Figure 4:
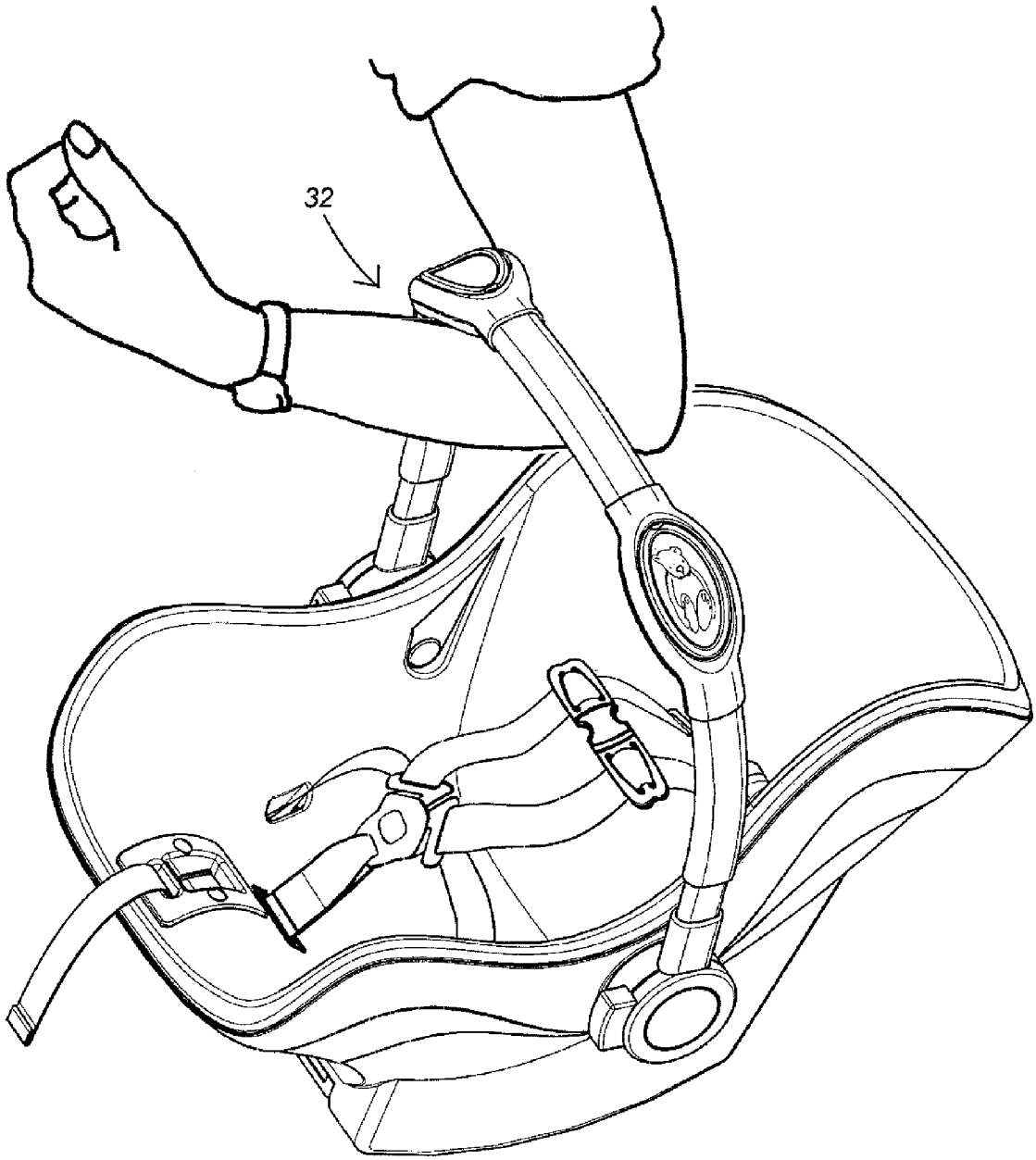
FIG. 4 is a perspective view showing a woman carrying the infant carrier in the crook of her elbow.

Carry handle 20 is used to pick up and carry infant carrier 10 with an infant (not shown) seated in the infant carrier 10 and secured with the harness system 18. The total carrying weight is the total weight of the infant, up to 20 pounds or even more, and the infant carrier—usually several pounds. In addition to the burden of the total carrying weight, infant carriers are awkward to carry because they are large and their centers of gravity force difficult carrying postures. Men, with their typically longer reach and more strength tend to carry an infant carrier by grasping the top grip area 24 and lifting the infant carrier/infant. They then carry the infant carrier/infant at their side with the unbalanced load rubbing against their leg. Women, with their typically shorter reach and lower strength tend to carry an infant carrier by placing one of the carry handle 10 curved sections 26*a*, 26*b* in the crook of their elbow 32 as illustrated in FIG. 4. The infant carrier/infant are then carried more nearly in front of the woman and more balanced or centered on her torso. This posture also allows the infant carrier/infant to be nearer the mother's face and thus more visible and in a more protected position in front of the mother.

The carry handle of the infant seat of the present invention includes an indicia receiving area on the outer face of the carry handle. The indicia receiving area will commonly be located on at least one, and oftentimes both, of the curved connection pieces, if they exist in the design. In other designs the indicia receiving area may appear on at least one of the pair of generally vertical legs of the handle. The indicia receiving area may exist, though not preferred, on the generally horizontal top grip of the carry handle.

The indicia receiving area will commonly, but not necessarily, exist within an enlarged cushioned area of the carry handle. The indicia receiving area may be recessed into the enlarged cushion area or recessed into the handle itself if the enlarged cushion area does not exist. The indicia receiving area will include a retainer that will act to secure the indicia within the indicia receiving area. The retainer is preferably, but is not necessarily, removable so the indicia can be replaced. The retainer may be permanent, however, if there is alternative means for the indicia to be replaced, for instance, a panel that can be repositioned, or a slot which is sized for the acceptance of the indicia. The retainer may further be deformable to allow for its removal.

Figure 3:
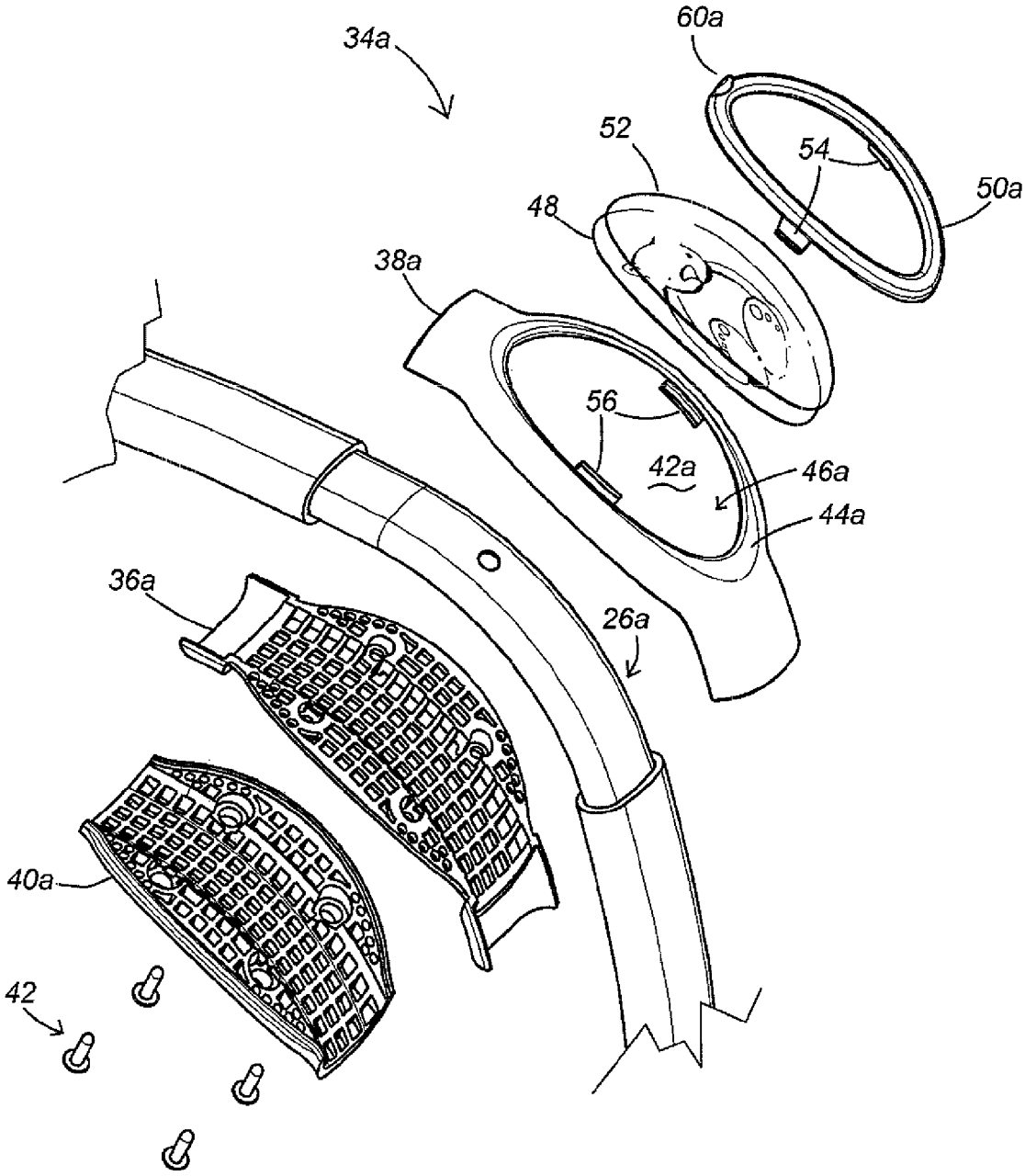
FIG. 3 is a partial exploded view of the carry handle showing the preferred construction of the enlarged cushion area.
Figure 7:
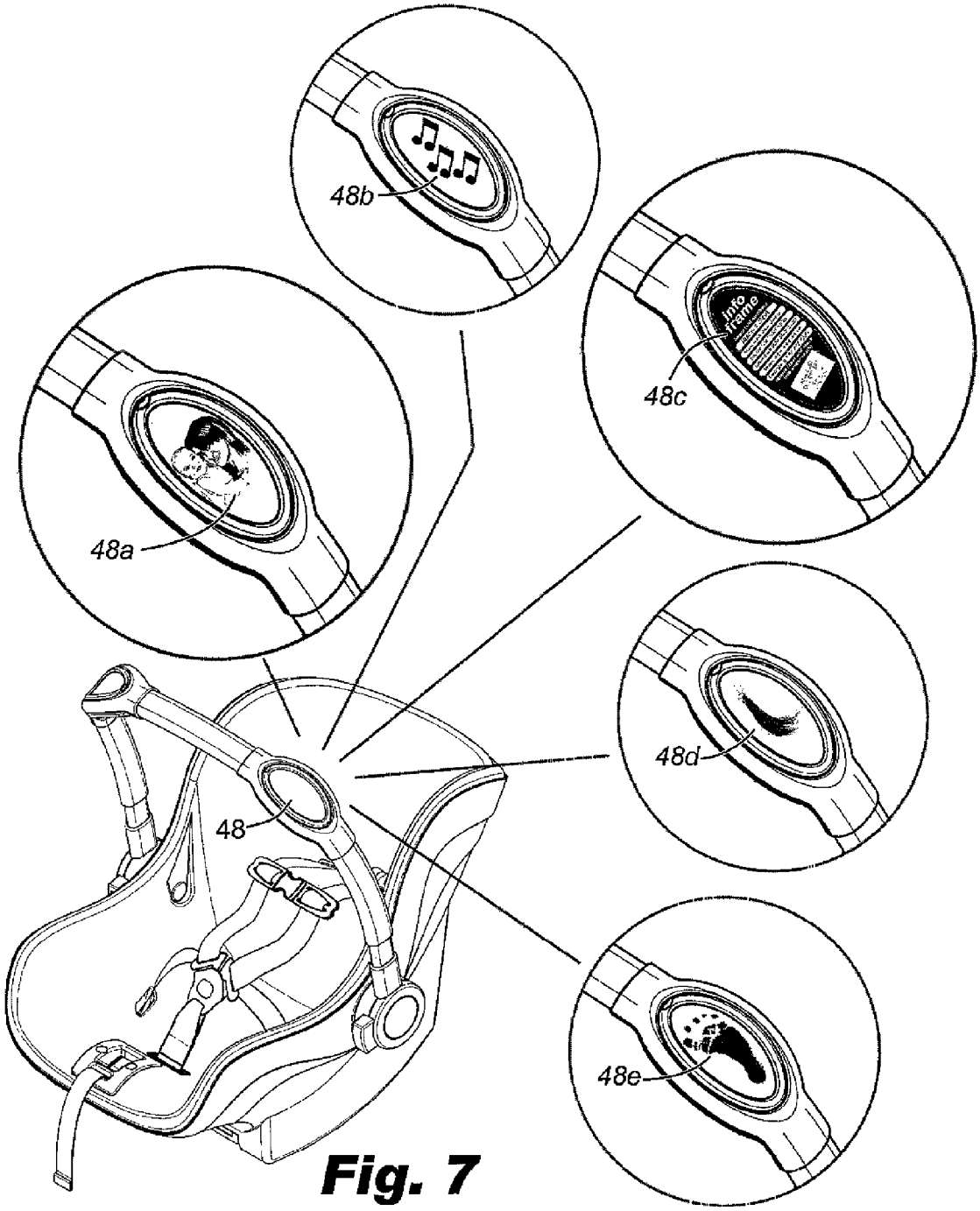
FIG. 7 is a perspective partially exploded view of the infant carrier with the indicia located in the enlarged cushion area of the handle.

Returning now to FIG. 1, it can be seen that the carry handle 20 of infant carrier 10 has enlarged cushion areas 34*a*, 34*b* on curved sections 26*a*, 26*b* Going now to FIG. 3, the preferred embodiment the enlarged cushion areas 34 comprise inner cushion components 36*a*, 36*b*;outer cushion components 38*a*, 38*b*;and are secured over curved sections 26 by screws 42 Enlarged cushion areas 34*a*, 34*b* may also have soft pads 40*a*, 40*b* which may be molded integrally with inner cushion components 36*a*, 36*b*;or removably attached by any of several common mechanical or adhesive means. Still referring to FIG. 3, outer cushion components 38*a*, 38*b* have an area for receipt of indicia, such as picture areas 42*a*, 42*b* which may be an outer surface 44*a*, 44*b* of outer cushion component 38*a*, 38*b*;or, as shown, a recessed surface 46*a*, 46*b*. A printed image 48 may be loosely placed in picture areas 42 or on recessed surfaces 46, if present, and secured with trim bezels 50*a*, 50*b*. Trim bezels 50 attach with snap tabs 54 penetrating snap tab holes 56 in outer cushion components 38. Trim bezels 50 can be secured by other permanent or temporary means such as commonly found on kitchen containers or battery doors of small electronics or even by screws In this preferred construction, trim bezels 50 are essentially permanently attached but may be flexed opposite snap tabs 54 by lifting deflection tabs 60*a*, 60*b* sufficiently to allow removal and replacement of printed image 48 or other indicia. Printed image 48 can be advertising, warning information, point-of-sale information or instructional matter supplied by the manufacturer or a photograph supplied by the consumer. Various other security or identification information may also be placed in the picture area. As shown in FIG. 7, security or identification information may include, but is not limited to, photograph 48*a*, music playing device 48*b*, printed information such as emergency medical or contact information 48*c*, lock of hair 48*d*, fingerprint or footprint 48*e*, or even a small electronic tracking or GPS device (not shown). It is foreseen that in various embodiments, indicia such as a music playing device or sound playing device may also be positioned within the picture area, allowing music to play for the amusement of the child, or allowing the recording of the mother or other's voice to be replayed and calm the child when the child's parents are not available.

A clear protective lens 52 may be supplied as in FIG. 3 or be molded as an integral part of trim bezel 50 as in FIG. 5 and FIG. 6, or may be omitted. The protective lens may also be opaque or solid in color to hide the picture area if the picture area is not being used or if it is desired that others not be able to see what is being stored within the picture area.

Construction of infant carrier handles must accommodate at least the often conflicting needs for strength, attractive styling, good ergonomics, light weight, and reasonable cost. The current common construction is a one-piece molded plastic handle with many functional and aesthetic details molded-in. Sometimes, additional small components such as grips are added as assembled parts. This construction results in a less than favorable strength-to-weight ratio, expensive and complex tooling, and difficulty in optimizing ergonomics.

But the described preferred construction uses aluminum or other metal extrusion 58 to optimize the strength-to-weight ratio of the handle and to minimize tooling cost. Where detail is needed, as in the enlarged cushion areas 34 and picture area 42, it is added with thin, simple, light parts which do not need to supply strength to the carry handle 20 proper. However, the multi-component enlarged cushion areas 34*a*, 34*b* described above and/or the picture areas described above may be adapted to a one-piece molded carry handle of uniform or non-uniform cross section. By way of example, FIG. 5 shows a one-piece molded plastic carry handle 20 with an enlarged cushion area 34, a separate soft pad 40 and picture area 42. FIG. 6 show a one-piece plastic carry handle with an enlarged cushion area 34 and a picture area 42.

Described herein is an infant carrier with a carry handle wherein the carry handle includes a pair of generally vertical legs and a generally horizontal leg. The generally s horizontal leg connects the pair of generally vertical legs Each of the pair of generally vertical legs and the generally horizontal leg include an inner face and an outer face, said inner and outer face being separated by a width. The carry handle will further include at least one enlarged cushion area, wherein the enlarged cushion area includes an inner component and an outer component. The inner component is positioned over a portion of the inner face and the outer component is positioned over a portion of the outer face. The inner component includes a soft cushion area and the outer component includes an outer face, wherein the outer face is configured for receipt of indicia.

In certain embodiments of the carrier with the carry handle the handle will include a pair of curved transition legs which connect the generally horizontal leg between the pair of generally vertical legs. The enlarged cushion area may be positioned on one of the curved transition legs. The inner and outer component of the enlarged cushion area may be joined over the leg of the handle The enlarged cushion component may include a retainer to secure the indicia within the enlarged cushion area. The retainer may be removably attached to the outer component of the enlarged cushion area and may be deformable. A recessed area may exist within the enlarged cushion area. The indicia may include a photograph, printed information, emergency information, medical information, contact information, a fingerprint, a footprint, a lock of hair, a tracking device, a GPS device, a music-playing device or a sound-playing device. The legs may have a uniform or non-uniform cross-section. The legs may be constructed of aluminum or plastic.

Also described herein is an infant carrier having a carry handle, the carry handle including a continuous inner face and a continuous outer face, wherein the outer face is connected to the inner face and separated from the inner face by a width. The handle further includes an indicia receiving area located on a portion of the outer face. The indicia receiving area includes a retainer that is configured to removably secure an indicia within the indicia receiving area. In certain embodiments the retainer is deformable to allow removal and replacement of the indicia In further embodiments the retainer is removably attached to the outer face. In certain embodiments the indicia may include a photograph, printed information, emergency information, medical information, contact information, a fingerprint, a footprint, a lock of hair, a tracking device, a GPS device, a music-playing device or a sound-playing device.

In the foregoing description, certain terms have been used for brevity, clearness, illustration and understanding; but no unnecessary limitations are to be implied therefrom beyond the requirements of the prior art, because such terms are used for descriptive purposes and are intended to be broadly construed. Moreover, this invention has been described in detail with reference to specific embodiments thereof including the respective best modes for carrying out each embodiment. It shall be understood that these illustrations are by way of example and not by way of limitation.

What is claimed is:

1. An infant carrier with a carry handle wherein said carry handle comprises:

a pair of generally vertical legs;

a generally horizontal leg, wherein said generally horizontal leg connects said pair of generally vertical legs, further wherein each of said pair of generally vertical legs and said generally horizontal leg include an inner face and an outer face, said inner and outer face being separated by a width;

a pair of enlarged cushion areas located on said carry handle, each cushion area at an intersection of one of said pair of generally vertical legs and said generally horizontal leg, wherein said enlarged cushion area includes an inner component and an opposed outer component, wherein said inner component is positioned over a portion of said inner face and said outer component is positioned over a portion of said outer face, further wherein said inner component includes a soft cushion area and said outer component includes an outer face, wherein said outer face is configured for receipt of removable indicia.

2. The carrier with a carry handle of claim 1 which further comprises:

a pair of curved transition legs which connect said generally horizontal leg between said pair of generally vertical legs.

3. The carrier with a carry handle of claim 2 wherein said at least one enlarged cushion area is positioned on at least one of said pair of curved transition legs.

4. The carrier with a carry handle of claim 1 wherein said inner component and said outer component are joined, encompassing said inner face, said outer face and said width separating said inner face and said outer face.

5. The carrier with a carry handle of claim 1 wherein said outer component includes a retainer configured to removably secure said indicia.

6. The carrier with a carry handle of claim 5 wherein said retainer is deformable to allow removal and replacement of said indicia.

7. The carrier with a carry handle of claim 5 wherein said retainer is removably attached to said outer component.

8. The carrier with a carry handle of claim 1 wherein said outer component includes a recessed area for the acceptance of said indicia.

9. The carrier with a carry handle of claim 1 wherein said indicia is chosen from the group consisting of a photograph, printed information, emergency information, medical information, contact information, a fingerprint, and a footprint.

10. The carrier with a carry handle of claim 1 wherein said pair of generally vertical legs and said generally horizontal leg have a generally uniform cross-section.

11. The carrier with a carry handle of claim 1 wherein said pair of generally vertical legs and said generally horizontal leg have a non-uniform cross section.

12. The carrier with a carry handle of claim 1 wherein said pair of generally vertical legs and said generally horizontal leg are constructed of aluminum.

13. The carrier with a carry handle of claim 1 wherein said pair of generally vertical legs and said generally horizontal leg are constructed of plastic.

14. The carrier with carry handle of claim 1 wherein said outer face further comprises at least one lifting deflection tab.

15. The carrier with carry handle of claim 1 wherein said outer face is retained in said outer component by a pair of snap tabs and snap tab holes.

16. The carrier with carry handle of claim 14 wherein said outer face comprises a pair of lifting deflection tabs.

17. The carrier with a carry handle of claim 1 wherein said outer component further comprises a device.

18. The carrier with a carry handle of claim 17 wherein said device is selected from the group consisting of a tracking device, a GPS device, a music-playing device and a sound-playing device.

* * * * *

UNITED STATES PATENT AND TRADEMARK OFFICE

CERTIFICATE OF CORRECTION

PATENT NO. : 8,033,599 B2
APPLICATION NO. : 12/039184
DATED : October 11, 2011
INVENTOR(S) : Meeker et al.

It is certified that error appears in the above-identified patent and that said Letters Patent is hereby corrected as shown below:

Column 8, line 54, claim 16, delete as printed and insert the following:

--16. The carrier with carry handle of claim 14 wherein said outer face further comprises a pair of lifting deflection tabs.--

Signed and Sealed this
Twentieth Day of December, 2011

David J. Kappos

David J. Kappos
*Director of the United States Patent and Trademark Office*